US005924860A

United States Patent [19]

Massey et al.

[11] Patent Number: 5,924,860

[45] Date of Patent: Jul. 20, 1999

[54] THICKWALL GAS BURNER ASSEMBLY

[75] Inventors: Dale Massey, Orland Park; Darryl Williams, Plainfield, both of Ill.

[73] Assignee: Harper-Wyman Company, Aurora, Ill.

[21] Appl. No.: 08/919,914

[22] Filed: Aug. 28, 1997

[51] Int. Cl.[6] ..... F23Q 3/00

[52] U.S. Cl. ..... 431/266; 431/354; 126/39 E

[58] Field of Search ..... 431/266, 264, 431/341, 349, 354; 126/39 E; 29/890.02; 72/267

[56] References Cited

U.S. PATENT DOCUMENTS

| | | | |
|---|---|---|---|
| 1,004,291 | 9/1911 | Merril . | |
| 2,099,205 | 11/1937 | Harper . | |
| 2,156,533 | 5/1939 | Harper . | |
| 2,276,629 | 3/1942 | Rich . | |
| 2,297,762 | 10/1942 | Harper . | |
| 2,337,240 | 12/1943 | Harper et al. . | |
| 2,372,573 | 3/1945 | Harper . | |
| 2,385,413 | 9/1945 | Harper . | |
| 2,625,993 | 1/1953 | Lamar . | |
| 3,301,311 | 1/1967 | Stohrer, Jr. et al. . | |
| 3,796,535 | 3/1974 | De Gouville . | |
| 3,858,811 | 1/1975 | Mizerak et al. . | |
| 4,626,196 | 12/1986 | Stohrer, Jr. . | |
| 4,757,801 | 7/1988 | Le Monnier de Gouville et al. . | |
| 4,810,188 | 3/1989 | Kwiatek . | |
| 4,846,671 | 7/1989 | Kwiatek . | |
| 4,886,043 | 12/1989 | Homer . | |
| 4,891,006 | 1/1990 | Le Monnier de Gouville et al. . | |
| 5,002,038 | 3/1991 | Riehl | 431/266 |
| 5,085,202 | 2/1992 | Riehl . | |
| 5,103,545 | 4/1992 | Riehl . | |
| 5,125,390 | 6/1992 | Riehl . | |
| 5,133,658 | 7/1992 | Le Monnier De Gouville et al. . | |
| 5,149,262 | 9/1992 | Riehl . | |
| 5,152,276 | 10/1992 | Brock et al. . | |
| 5,160,256 | 11/1992 | Riehl . | |
| 5,246,365 | 9/1993 | Himmel et al. . | |
| 5,328,357 | 7/1994 | Riehl . | |
| 5,328,358 | 7/1994 | Riehl . | |
| 5,364,264 | 11/1994 | Kwiatek . | |
| 5,405,263 | 4/1995 | Gerdes et al. | 431/354 |
| 5,443,380 | 8/1995 | Riehl . | |

FOREIGN PATENT DOCUMENTS

| | | | |
|---|---|---|---|
| 1260811 | 4/1961 | France | 431/349 |
| 1394223 | 2/1965 | France | 431/349 |
| 576000 | 5/1930 | Germany | 431/349 |

*Primary Examiner*—Ira S. Lazarus
*Assistant Examiner*—Sara Raab
*Attorney, Agent, or Firm*—Mason, Kolehmainen, Rathburn & Wyss; Joan Pennington

[57] ABSTRACT

A gas burner assembly is provided for use with a gas stove top. The gas burner assembly includes a burner base with an inlet receiving a mixture of gas and primary air. A burner cap is supported by the burner base. The burner base and the burner cap together define a burner fuel chamber. The burner cap includes a plurality of main burner ports where the air and gas mixture exits and burns in the presence of secondary air. A spark ignition assembly is operatively associated with the burner base for igniting the mixture. The burner cap includes an ignition pocket for capturing gas for reignition for drafts or door slam conditions. A venturi assembly communicates with the burner base inlet providing the air and gas mixture. The venturi assembly includes mounting features for mounting the gas burner assembly to the gas stove, thereby eliminating the need for fasteners to secure the burner base to the gas stove.

11 Claims, 3 Drawing Sheets

Fig. 1
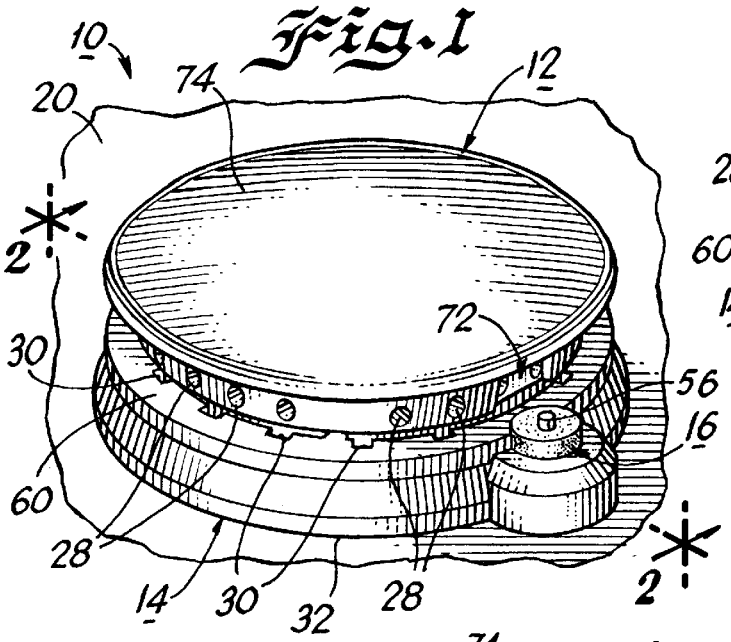
Fig. 3
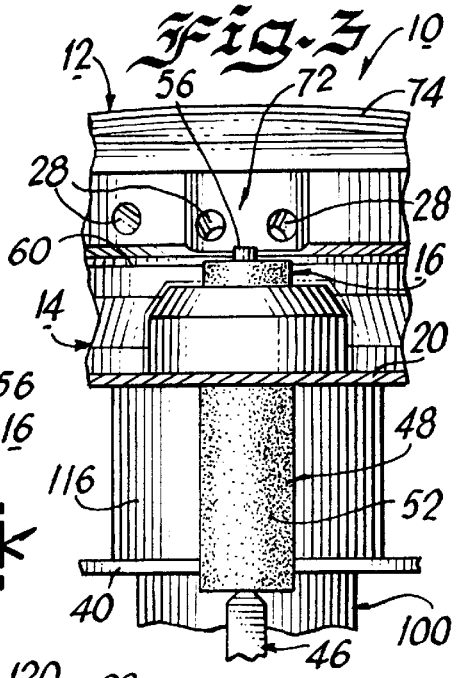
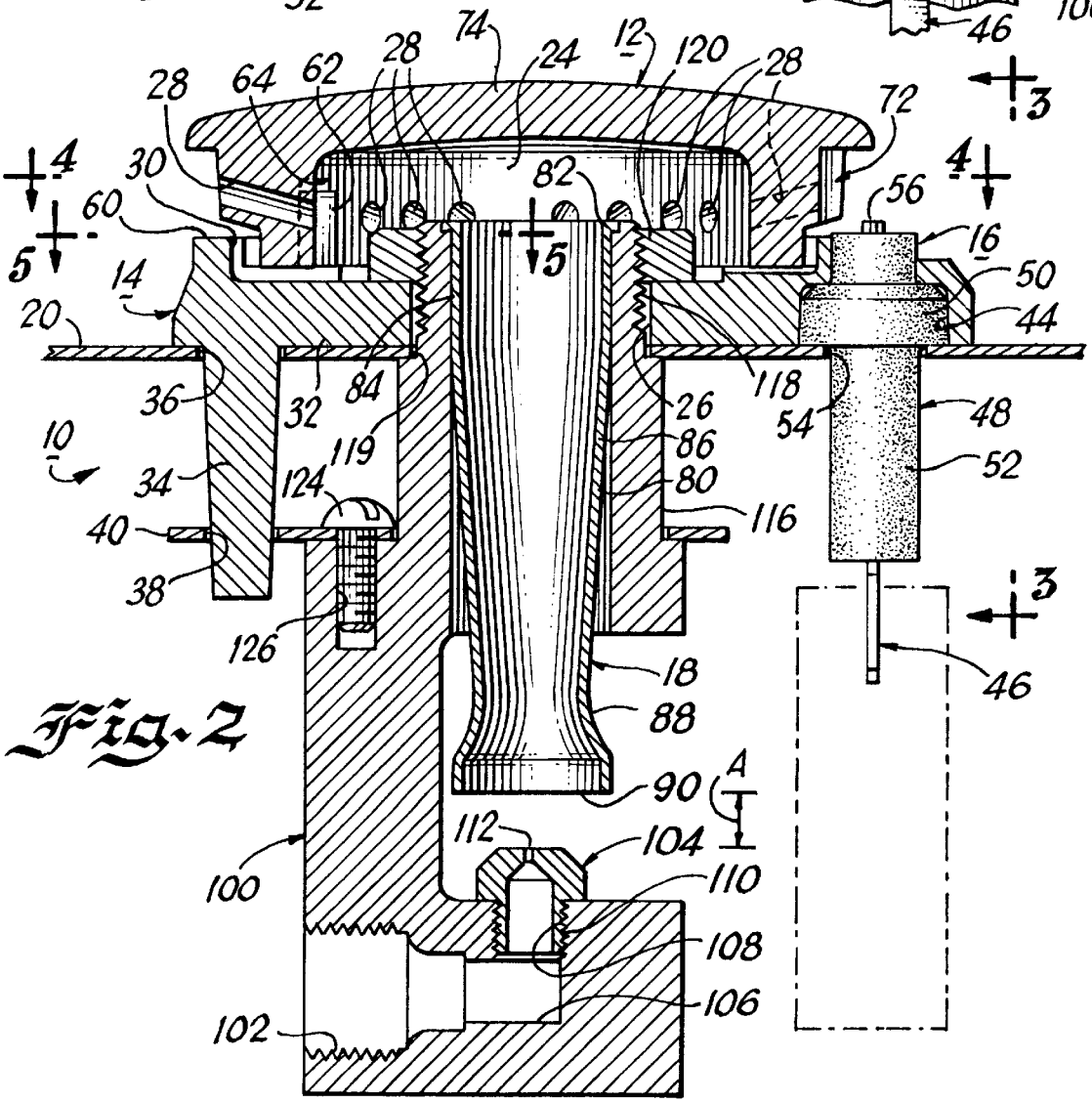
Fig. 2

Fig. 4
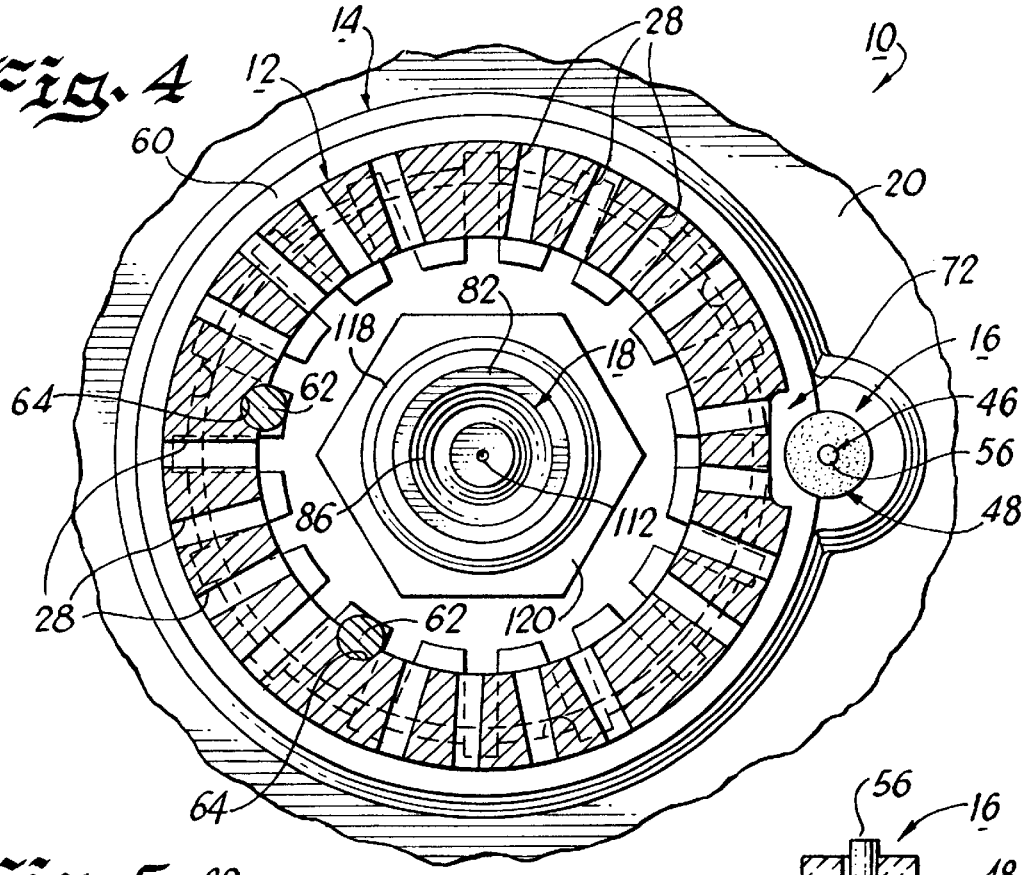
Fig. 5
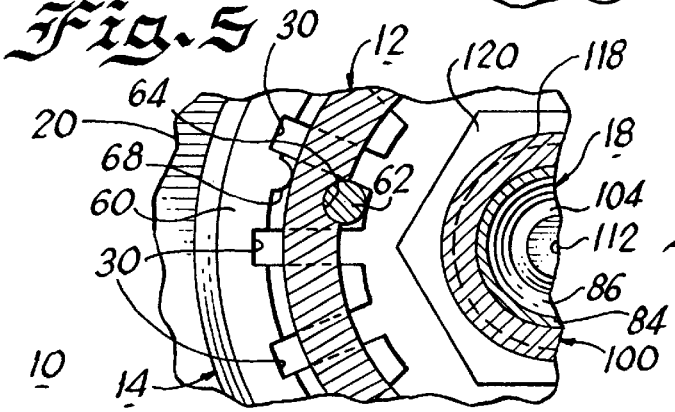
Fig. 7
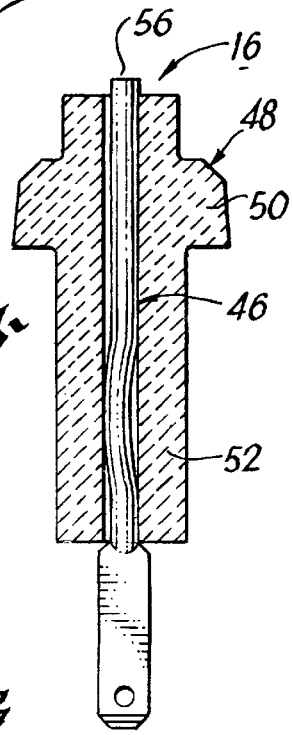
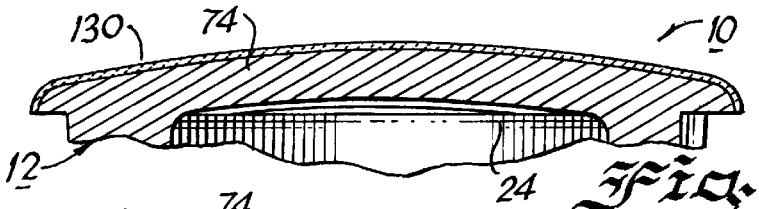
Fig. 8
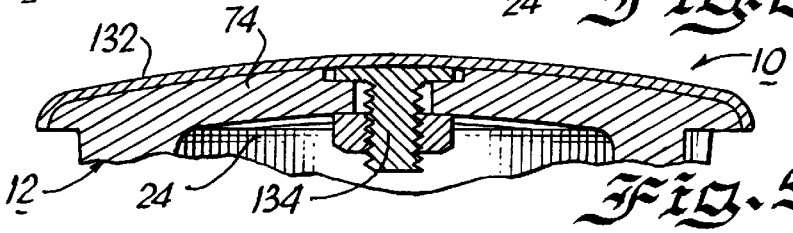
Fig. 9

12
74
28
72
28
28
24
64
82
120
84
62
64
28
68
30
30
80
60
68
26
18
86
7
56
16
88
62
44
14
34
68
32
48
50
90
10
36
118
52
46
116
20
119
7
126
112
104
54
110
100
108

THICKWALL GAS BURNER ASSEMBLY

FIELD OF THE INVENTION

The present invention relates generally to gas burners, and more particularly to a thickwall gas burner assembly for a gas stove.

DESCRIPTION OF THE PRIOR ART

Various arrangements of gas burners are known in the art. In appliances such as gas stoves or ranges and cook tops, the gas burner typically includes a metal burner body defining a burner fuel chamber with an inlet that receives a mixture of gas and primary air and includes burner ports where the mixture exits and burns in the presence of secondary air to perform a heating and cooking function. Depending on the application, a burner may be a formed body of electrically conductive material, such as stamped sheet metal of an aluminum alloy, or other materials, such as cold rolled steel, galvanized steel or stainless steel. In many gas burner applications, a wide range of fuel flow rates is required.

Spark ignition typically is used with gas burners. Spark ignition avoids the energy consumption and heat caused by a standing igniter pilot flame that was often used in the past to ignite gas burners, such as gas range top and oven burners. Examples of spark ignited gas burners are provided by U.S. Pat. No. 4,626,196 issued Dec. 2, 1986, U.S. Pat. No. 4,810,188 issued Mar. 7, 1989 and U.S. Pat. No. 4,846,671 issued Jul. 11, 1989, assigned to the assignee of the present invention.

While these gas burner assemblies provide improvements over many existing gas burner arrangements, it is desirable to provide an improved thickwall gas burner assembly that is capable of reliable ignition and combustion operation throughout a wide range of gas flow rates, that can be readily assembled during manufacture, that can be readily removed and reassembled during use, for example, for cleaning and maintenance, and that is rugged and not easily breakable or damaged both during assembly and use.

SUMMARY OF THE INVENTION

Among the principal objects of the present invention are to provide an thickwall gas burner assembly; to provide a new and improved thickwall gas burner assembly that provides effective and reliable operation and includes an integral spark ignition arrangement; and to provide a gas burner assembly overcoming one or more of the disadvantages of known gas burner arrangements.

In brief, the objects and advantages of the present invention are achieved by a gas burner assembly for a gas stove top. The gas burner assembly includes a burner base with an inlet receiving a mixture of gas and primary air. A burner cap is supported by the burner base. The burner base and the burner cap together define a burner fuel chamber. The burner cap includes a plurality of main burner ports where the air and gas mixture exits and burns in the presence of secondary air. A spark ignition assembly is operatively associated with the burner base for igniting the mixture. A venturi assembly communicates with the burner base inlet providing the air and gas mixture. The venturi assembly includes mounting features for mounting the gas burner assembly to the gas stove, thereby eliminating the need for fasteners to secure the burner base to the gas stove.

BRIEF DESCRIPTION OF THE DRAWINGS

The present invention together with the above and other objects and advantages may best be understood from the following detailed description of the preferred embodiments of the invention illustrated in the drawings, wherein:

FIG. 1 is a perspective view of a gas burner assembly constructed in accordance with the principles of the present invention;

FIG. 2 is a an enlarged cross-sectional view taken along the line 2—2 of FIG. 1;

FIG. 3 is a fragmentary cross-sectional view taken along the line 3—3 of FIG. 2;

FIG. 4 is a cross-sectional view taken along the line 4—4 of FIG. 2;

FIG. 6 is an exploded perspective view of the gas burner assembly of FIG. 1;

FIG. 7 is a cross-sectional view taken along the line 7—7 of FIG. 6;

FIG. 8 is a fragmentary cross-sectional view illustrating a burner cap of the gas burner assembly of FIG. 1; and FIG. 9 is a fragmentary cross-sectional view illustrating an alternative burner cap of the gas burner assembly of FIG. 1.

DETAILED DESCRIPTION OF THE PREFERRED EMBODIMENTS

Figure 5:
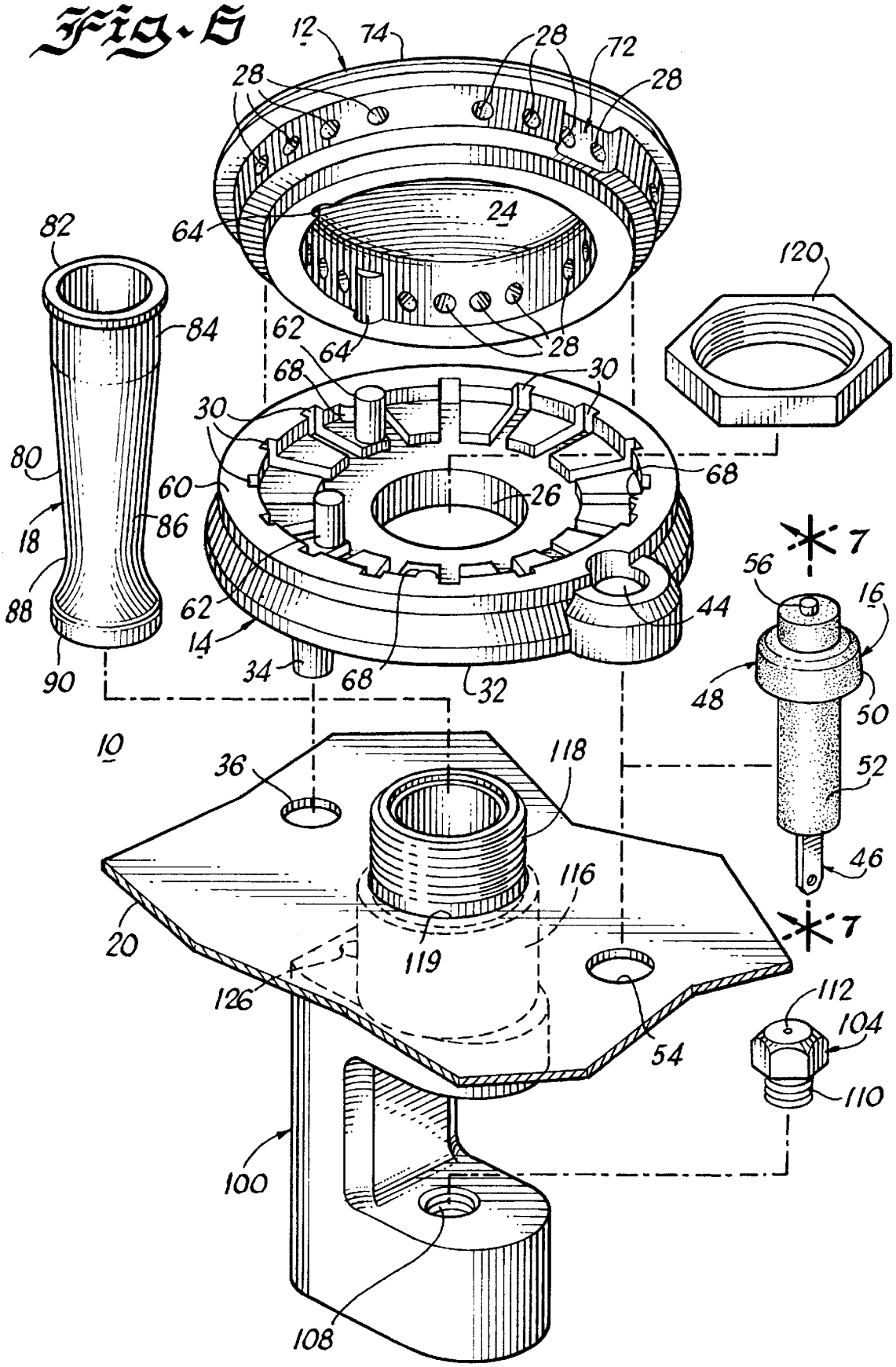
FIG. 5 is a fragmentary cross-sectional view taken along the line 5—5 of FIG. 2.

Referring now to the drawings, in FIGS. 1–9, there is illustrated a thickwall gas burner assembly designated as a whole by the reference character 10 and arranged in accordance with principles of the present invention. In accordance with features of the invention, the gas burner assembly 10 includes a thickwall burner cap 12 and burner base 14 and is capable of reliable operation throughout a wide range of gas low rates. The gas burner assembly 10 can be easily assembled during manufacture and can be easily removed and reassembled for cleaning and maintenance. The gas burner assembly 10 is rugged and not easily breakable or damaged both during assembly and use.

Having reference also to FIG. 6, an exploded perspective view of the gas burner assembly 10 is shown. The gas burner assembly 10 includes a burner cap 12, a burner base 14, a spark ignition assembly 16, and a venturi assembly 18.

In FIG. 1, a perspective view of a gas burner assembly 10 is shown assembled with a gas stove top surface 20. Having reference also to FIGS. 2–5, cross-sectional view of the gas burner assembly 10 are shown assembled with the gas stove top surface 20. The gas burner cap 12 is supported by gas burner base 14 which together define a burner fuel chamber 24. An inlet 26 to the gas burner base 14 receives a mixture of gas and primary air from the venturi assembly 18. The gas burner cap 12 includes a plurality of main burner ports 28 where the mixture exits and burns in the presence of secondary air. The gas burner base 14 also includes a plurality of secondary burner ports 30 where the mixture exits and burns in the presence of secondary air.

An impact extrusion process preferably is used in the manufacture of the gas burner cap 12. The impact extrusion process facilitates more detail without additional steps and enables the use of alloys with higher melting points. The main burner ports 28 preferably are circular in configuration and advantageously are machined or drilled in the burner cap 12 to provide a desired main flame characteristic. The gas burner cap is formed of an electrically conductive material, such as impact extruded aluminum 1100 alloy. A casting process can used in the manufacture of the gas burner base 14, formed of an electrically conductive material, such as an A3600 aluminum alloy. The secondary burner ports 30 provide a small secondary flame particularly effective for maintaining combustion at low fuel rates. The small secondary flame effectively maintains stable combustion, avoiding externally caused disruptions otherwise resulting, such as, from an oven door slam. The secondary burner ports 30 are included within the base casting without requiring additional machine processes in the manufacture of the gas burner base 14.

The gas burner base 14 includes a lower, sealing surface 32 mating with the gas stove top surface 20. A downwardly depending tapered leg or locating post 34 is received through an opening 36 in the gas stove top surface 20 and through an aligned opening 38 in a lower cross member 40. A stepped opening 44 is provided through the gas burner base 14 for receiving and positioning the spark ignition assembly 16 relative to the burner ports 28 and 30. The spark ignition assembly 16 includes a spark electrode or wire 46 formed of electrically conductive material for connection to a source of high voltage potential (not shown) and a support member 48 formed of an electrically insulative material, such as a ceramic material. The support member 48 enclosing wire 46 extends through the stepped opening 44 with an enlarged upper portion 50 of the support member is seated on and supported by the gas stove top surface 20. A lower, elongated body portion 52 of the support member 48 is received through an aperture 54 in the gas stove top surface 20 and extends below gas stove top surface 20 for connecting the spark electrode 46 to the high voltage potential. An upper terminal end 56 of the spark electrode 46 extends above the support member 48 and above an upper, annular surface 60 of the gas burner base 14.

A pair of upwardly extending locating posts 62 formed in the gas burner base 14 are received within a pair of complementary indexing recesses 64 formed within the gas burner cap 12 proximate to a mating annular surface 66 of the burner cap. The upper, annular surface 60 of the gas burner base 14 also is formed with locating bosses 68. The two locating posts 62 provides an obvious misalignment indication if the gas burner cap 12 is not seated properly on the gas burner base 14 with the locating posts 62 received in the complementary indexing recesses 64 of the gas burner cap.

The gas burner cap 12 includes an ignition pocket generally designated by 72 formed in a sidewall 74 below a topwall or top 74. The upper terminal end 56 of the spark electrode 46 is positioned near the ignition pocket 72 with the gas burner assembly 10 assembled with a gas stove top surface 20, as been seen in FIGS. 1, 3 and 4.

In accordance with a feature of the invention, the venturi assembly 18 is arranged to be mounted with the gas burner base 14 to eliminate the need for additional fasteners to secure the gas burner base 14 to the gas stove top surface 20 as conventionally required. The venturi assembly 18 includes an integral venturi tube 80 having an upper flange 82 connecting to a straight tubular section 84, an inwardly, tapered tubular section 86, and an outwardly extending tubular section 88 connecting to a lower end 90. The venturi assembly 18 includes an integral housing member 100 having an inlet 102 for connection with a gas supply (not shown). The gas inlet 102 of housing member 100 supplies gas to an orifice fitting 104 via a passageway 106. The orifice fitting 104 is mounted in a threaded opening 108 of housing member 100 and has an inlet 110 communicating with the gas supply passageway 106 and a gas outlet orifice 112 providing a gas supply jet into the venturi tube 80. The gas outlet orifice 112 is spaced below the lower end 90 of the venturi tube 80 a set distance corresponding to a primary air gap for the venturi assembly 18 indicated by an arrow labeled A in FIG. 2. The housing member 100 includes a cylindrical body portion 116 with an upper threaded portion 118 that is slidingly received through an opening 119 in the stove top surface 20 and through the gas and air mixture inlet 26 of the gas burner base 14. The upper threaded housing portion 118 is mounted by a threaded mixer lock nut 120 and a fastener 124 threadingly receiving in housing aperture 126 is used to mount the housing 100 with the cross member 40.

Referring to FIG. 6, the gas burner assembly 10 is readily assembled and reassembled after cleaning or maintenance. For example, first lower portion 52 of the spark ignition support member 48 is slidingly received downwardly through opening 54 in the stove top surface 20. The venturi tube 80 is inserted downwardly through the housing portions 118 and 116 until the upper flange 82 seats on the housing portion 118. The housing portion 118 of venturi assembly 18 is slidingly received through the stove top opening 119. The gas and air mixture inlet 26 of the gas burner base 14 is slidingly received on the housing portion 118 of venturi assembly 18 with the mounting post 34 of the gas burner base 14 slidingly inserted downwardly through stove top opening 36 and cross-member opening 38. The upper portion of support member 48 is received in the gas burner base stepped opening and the spark ignition assembly 16 is captured in position by the gas burner base 14 and the stove top 20. The lock nut 120 is mounted to the housing portion 118 to secure the venturi assembly 18 and gas burner base 14 to the stove top 20. The gas burner cap 12 is moved into press-fit engagement with the gas burner base 14 utilizing the cooperating indexing features 62, 64, and 68.

Referring now to FIGS. 8 and 9, fragmentary cross-sectional views illustrating the gas burner cap 12 are shown. In FIG. 8, a high temperature porcelain layer 130 is directly applied to the gas burner cap 12. Direct application of the high temperature porcelain layer 130 is possible with the gas burner cap 12 formed of the 1100 aluminum alloy.

In FIG. 9, there is illustrated an alternative arrangement of the gas burner cap 12 including a separate lid member 132 mounted to the gas burner cap 12 with a fastener 134. With gas burner cap 12 formed of other lower temperature aluminum alloys, the direct application of a porcelain layer is not possible and the use of the separate lid member 132 is preferred.

While the present invention has been described with reference to the details of the embodiments of the invention shown in the drawing, these details are not intended to limit the scope of the invention as claimed in the appended claims.

What is claimed is:

1. A gas burner assembly for use with a gas stove comprising:

a burner base with an inlet receiving a mixture of gas and primary air;

a burner cap supported by said burner base, said burner base and said burner cap defining a burner fuel chamber; said burner cap including a plurality of main burner ports where said mixture exits and burns in the presence of secondary air; said burner cap being formed of an electrically conductive material by an impact extrusion process;

spark ignition means mounted by said burner base for igniting said mixture; and venturi means communicating with said burner base inlet for providing said mixture, said venturi means including mounting means for mounting the gas burner assembly to the gas stove.

2. A gas burner assembly as recited in claim 1 wherein said burner base includes a plurality of secondary gas ports for providing stable combustion.

3. A gas burner assembly as recited in claim 1 wherein said burner base includes a locating post for insertion through a corresponding hole in a stove top surface.

4. A gas burner assembly as recited in claim 1 wherein said spark ignition means includes a spark ignition support member and wherein said burner base includes an opening for receiving said spark ignition support member, said spark ignition support member being seated on the stove top surface.

5. A gas burner assembly as recited in claim 1 wherein said burner base and said burner cap include cooperating means for mounting said burner cap onto said burner base.

6. A gas burner assembly as recited in claim 1 wherein said burner cap includes a porcelain top layer.

7. A gas burner assembly as recited in claim 1 wherein said burner cap includes a separate lid member removably mounted thereto.

8. A gas burner assembly for use with a gas stove comprising:

a burner base with an inlet receiving a mixture of gas and primary air; said burner base including a locating post for insertion through a corresponding hole in a stove top surface;

a burner cap supported by said burner base, said burner base and said burner cap defining a burner fuel chamber; said burner cap including a plurality of main burner ports where said mixture exits and burns in the presence of secondary air;

spark ignition means supported by said burner base for igniting said mixture; said burner cap including a recessed sidewall portion defining an ignition pocket near a spark electrode of said spark ignition means; and venturi means communicating with said burner base inlet for providing said mixture, said venturi means including mounting means for mounting the gas burner assembly to the gas stove.

9. A gas burner assembly as recited in claim 8 wherein said ignition pocket captures gas for reignition.

10. A gas burner assembly for use with a gas stove comprising:

a burner base with an inlet receiving a mixture of gas and primary air;

a burner cap supported by said burner base, said burner base and said burner cap defining a burner fuel chamber; said burner cap including a plurality of main burner ports where said mixture exits and burns in the presence of secondary air;

spark ignition means mounted by said burner base for igniting said mixture; and venturi means communicating with said burner base inlet for providing said mixture, said venturi means including mounting means for mounting the gas burner assembly to the gas stove;

said venturi means including an integral housing having a cylindrical body portion having an upper cylindrical body threaded portion, and wherein said mounting means for mounting the gas burner assembly to the gas stove include said upper cylindrical body threaded portion received through said burner base inlet and mounted by a lock nut.

11. A gas burner assembly as recited in claim 10 wherein said venturi means includes an integral venturi tube received through said cylindrical body portion of said integral housing.

* * * * *